US008330563B2

(12) United States Patent
Fujita

(10) Patent No.: US 8,330,563 B2
(45) Date of Patent: Dec. 11, 2012

(54) HIGH-FREQUENCY MEMBER ASSEMBLY WITH WAVEGUIDE

(75) Inventor: Akihisa Fujita, Anjo (JP)

(73) Assignee: Denso Corporation, Kariya, Aichi-Pref. (JP)

( * ) Notice: Subject to any disclaimer, the term of this patent is extended or adjusted under 35 U.S.C. 154(b) by 847 days.

(21) Appl. No.: 12/350,391

(22) Filed: Jan. 8, 2009

(65) Prior Publication Data

US 2009/0206961 A1 Aug. 20, 2009

(30) Foreign Application Priority Data

Feb. 19, 2008 (JP) ..... 2008-037385

(51) Int. Cl.
*H01P 1/04* (2006.01)

(52) U.S. Cl. ..... 333/254; 333/125

(58) Field of Classification Search ..... 333/32, 333/33, 35, 236, 239, 245, 248, 252, 254
See application file for complete search history.

(56) References Cited

U.S. PATENT DOCUMENTS

| | | | | |
|---|---|---|---|---|
| 2,561,130 | A * | 7/1951 | McClellan | 333/254 |
| 2,850,706 | A * | 9/1958 | Gabriel | 333/256 |
| 3,155,923 | A * | 11/1964 | Persson | 333/108 |
| 5,291,650 | A * | 3/1994 | Carvalho et al. | 29/600 |

FOREIGN PATENT DOCUMENTS

| | | |
|---|---|---|
| JP | 56-129402 | 10/1981 |
| JP | S63-020601 | 2/1988 |
| JP | 04-040101 | 2/1992 |
| JP | 2003-188601 | 7/2003 |
| JP | 3995929 | 8/2007 |
| JP | 2007-336299 | 12/2007 |

OTHER PUBLICATIONS

Japanese Office Action dated Jan. 5, 2010, issued in corresponding Japanese Application No. 2008-037385, with English translation.

* cited by examiner

*Primary Examiner* — Benny Lee
*Assistant Examiner* — Gerald Stevens
(74) *Attorney, Agent, or Firm* — Nixon & Vanderhye PC

(57) ABSTRACT

A high-frequency member assembly has two high-frequency members of which surfaces are attached to each other. Each member has a rectangular waveguide hole penetrating through the member and two choke grooves opened on the attaching surface. The waveguide holes communicate with each other to form a rectangular waveguide. An electromagnetic wave is transmitted through the waveguide. Each choke groove extends straight along a side of an end of the waveguide hole opened on the attaching surface to be away from the end of the waveguide hole by one quarter of the wavelength of the wave. The depth of each choke groove is equal to one quarter of the wavelength. The choke grooves of one member communicate with the choke grooves of the other member to substantially surround the waveguide with the choke grooves in an attaching area between the member.

12 Claims, 8 Drawing Sheets

1
2
3
4b
4c
4a
LATERAL DIRECTION
THICKNESS DIRECTION
LONGITUDINAL DIRECTION 1
3
31b(4b)
33b
31c(4c)
33c
31a(4a)
33a
3a
2a
23b
21b(4b)
23a
23c
21c(4c)
23c
21a(4a)
2

3
3a
31b(4b)
31a(4a)
33a
33b
31c(4c)
33c

HIGH-FREQUENCY MEMBER ASSEMBLY WITH WAVEGUIDE

CROSS-REFERENCE TO RELATED APPLICATION

This application is based upon and claims the benefit of priority of the prior Japanese Patent Application 2008-37385 filed on Feb. 19, 2008, so that the contents of which are incorporated herein by reference.

BACKGROUND

1. Technical Field

The present exemplary embodiment relates to a high-frequency member assembly with a waveguide wherein a choke structure is disposed near the waveguide in an attaching area between two high-frequency members attached to each other.

2. Description of Related Art

A high frequency device has a pair of high-frequency members attached to each other, and the members have respective waveguide portions communicating with each other as a waveguide. FIG. 1 is a sectional view of a high-frequency device and a plan view of a high-frequency member of the device to show a connection structure of a waveguide disclosed in Published Japanese Patent First Publication No. 2007-336299. FIG. 2 is a sectional view of a high-frequency device and a plan view of a high-frequency member of the device to show a connection structure of a waveguide disclosed in Japanese Patent No. 3995929.

As shown in FIG. 1 and FIG. 2, a high-frequency device has two high-frequency members 101 and 102 (or 101 and 103) of which surfaces are attached to each other. The members have respective waveguide portions 104 communicating with each other to form a single waveguide 104. The waveguide 104 is opened on the attaching surfaces of the members. An electromagnetic wave is transmitted through the waveguide 104. To prevent the electromagnetic wave from being leaked from an attaching area between the attaching surfaces of the members, a choke groove 105 is formed in the member 102 so as to surround the waveguide portion 104 of the member 102 (see FIG. 1) through a portion of the member 102, or two choke grooves 106 are formed in the member 103 so as to face the waveguide portion 104 of the member 102 through a portion of the member 103 (see FIG. 2). Each choke groove is placed away from the opened end of the waveguide portion 104 by $\lambda/4$ ($\lambda$ denotes the free space wavelength of the electromagnetic wave) and has the depth of $\lambda/4$.

With this structure, even when an opened space is formed between the attached surfaces of the members 101 and 102 (or 101 and 103), an inner wall of the member 102 (or 103) surrounding the waveguide 104 can be treated as an electric short point. Therefore, a high frequency device having the members 101 and 102 (or 101 and 103) can prevent the electromagnetic wave from being leaked from the opened space between the members. Especially, as compared with the choke grooves 106 imperfectly surrounding the waveguide 104, the choke groove 105 surrounding the waveguide 104 in all directions can reliably prevent the leakage of the wave.

However, when a single choke groove is formed in a high-frequency member so as to surround an open end of the waveguide 104 of the member, it is troublesome to form the high frequency device with the waveguide 104 surrounded by the choke groove.

Especially, when a choke groove is formed in a plate-shaped member with a waveguide portion, the member is initially punched to form a choke hole penetrating through the member in its thickness direction, and one opened end of the choke hole is covered with a dielectric substrate having a printed ground pattern to form a choke groove from the choke hole.

However, because the choke groove surrounds the waveguide portion through a wall portion of the member, it is required to support the wall portion by a supporting member until the choke hole is covered with the dielectric substrate.

Therefore, it is difficult to form the choke groove which surrounds the waveguide portion in all directions in an attaching area between high-frequency members attached to each other. That is, a portion of the high-frequency member inevitably remains between ends of the choke groove, and the electromagnetic wave is leaked through the portion of the high-frequency member. In this case, the transmission efficiency of the waveguide for the electromagnetic wave is lowered, and isolation of a first waveguide from a second waveguide adjacent to the first waveguide is degraded.

SUMMARY

An object of the present exemplary embodiment is to provide, with due consideration to the drawbacks of the conventional high-frequency device, a high-frequency member assembly wherein a choke structure is reliably disposed to surround a waveguide in an attaching area between high-frequency members attached to each other.

According to an aspect of this invention, the object is achieved by the provision of a high-frequency member assembly comprising a first high-frequency member having a first attaching surface and a second high-frequency member having a second attaching surface. The attaching surfaces are attached to each other to layer the high-frequency members in a thickness direction of the assembly. The first high-frequency member comprises a first waveguide hole and a first choke groove. The first waveguide hole extends in the thickness direction to have a first end opened on the first attaching surface. The first choke groove is opened on the first attaching surface and extends along the first end of the first waveguide hole to be away from the first end of the first waveguide hole by a predetermined distance. The second high-frequency member comprises a second waveguide hole and a second choke groove. The second waveguide hole extends in the thickness direction to have a second end opened on the second attaching surface and communicates with the first waveguide hole to form a waveguide from the waveguide holes. An electromagnetic wave is transmitted through the waveguide in the thickness direction. The second choke groove is opened on the second attaching surface to communicate with the first choke groove and extends along the second end of the second waveguide hole to be away from the second end of the second waveguide hole by the predetermined distance and to substantially surround the waveguide with the first and second choke grooves in an attaching area between the high-frequency members.

With this structure of the high-frequency member assembly, the wall of the waveguide acts as an electric short point for the electromagnetic wave transmitted through the waveguide. Further, a choke structure formed of the first and second choke grooves is placed away from the waveguide by the predetermined distance and substantially surrounds the waveguide in the attaching area between the high-frequency members.

Therefore, even when an opened space is formed between the high-frequency members, the assembly prevents the electromagnetic wave from being leaked from the opened space.

Further, no single choke groove surrounds the waveguide, but the first and second choke grooves disposed in the respective members surround the waveguide. Therefore, each of the choke grooves can be easily formed in the corresponding member. Accordingly, the first and second choke grooves surrounding the waveguide can be easily disposed in the assembly.

Moreover, the layout of each choke groove in the corresponding member can be set with a higher degree of freedom. Accordingly, the first and second choke grooves surrounding the waveguide can be reliably disposed in the assembly.

DETAILED DESCRIPTION OF THE PREFERRED EMBODIMENTS

Figure 1:
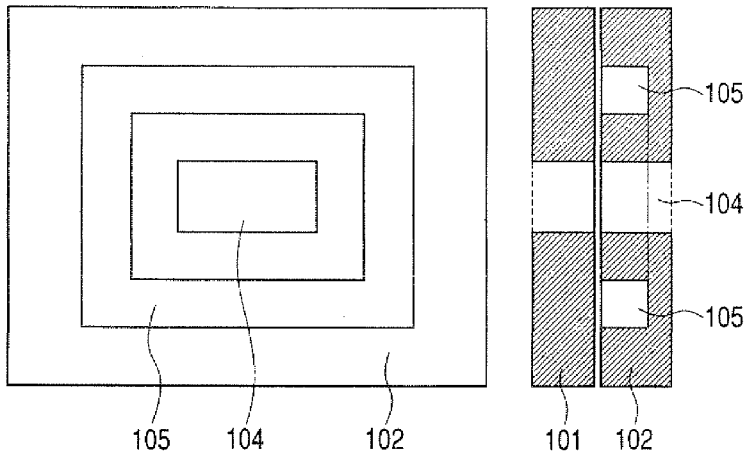
FIG. 1 (PRIOR ART)
FIG. 1 is a sectional view of a prior art high-frequency device and a plan view of a high-frequency member of the device.
Figure 2:
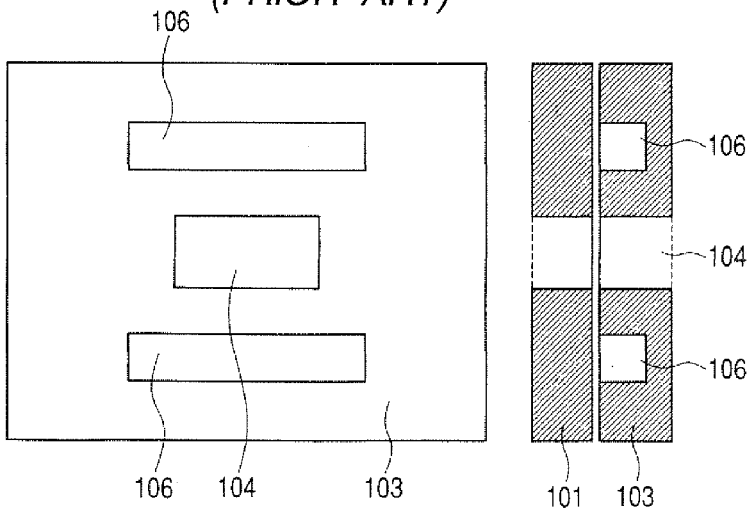
FIG. 2 (PRIOR ART)
FIG. 2 is a sectional view of a prior art high-frequency device and a plan view of a high-frequency member of the device.

Embodiments of the present invention will now be described with reference to the accompanying drawings, in which like reference numerals indicate like parts, members or elements throughout the specification unless otherwise indicated.

First Embodiment

Figures 3A, 3B, 3C:
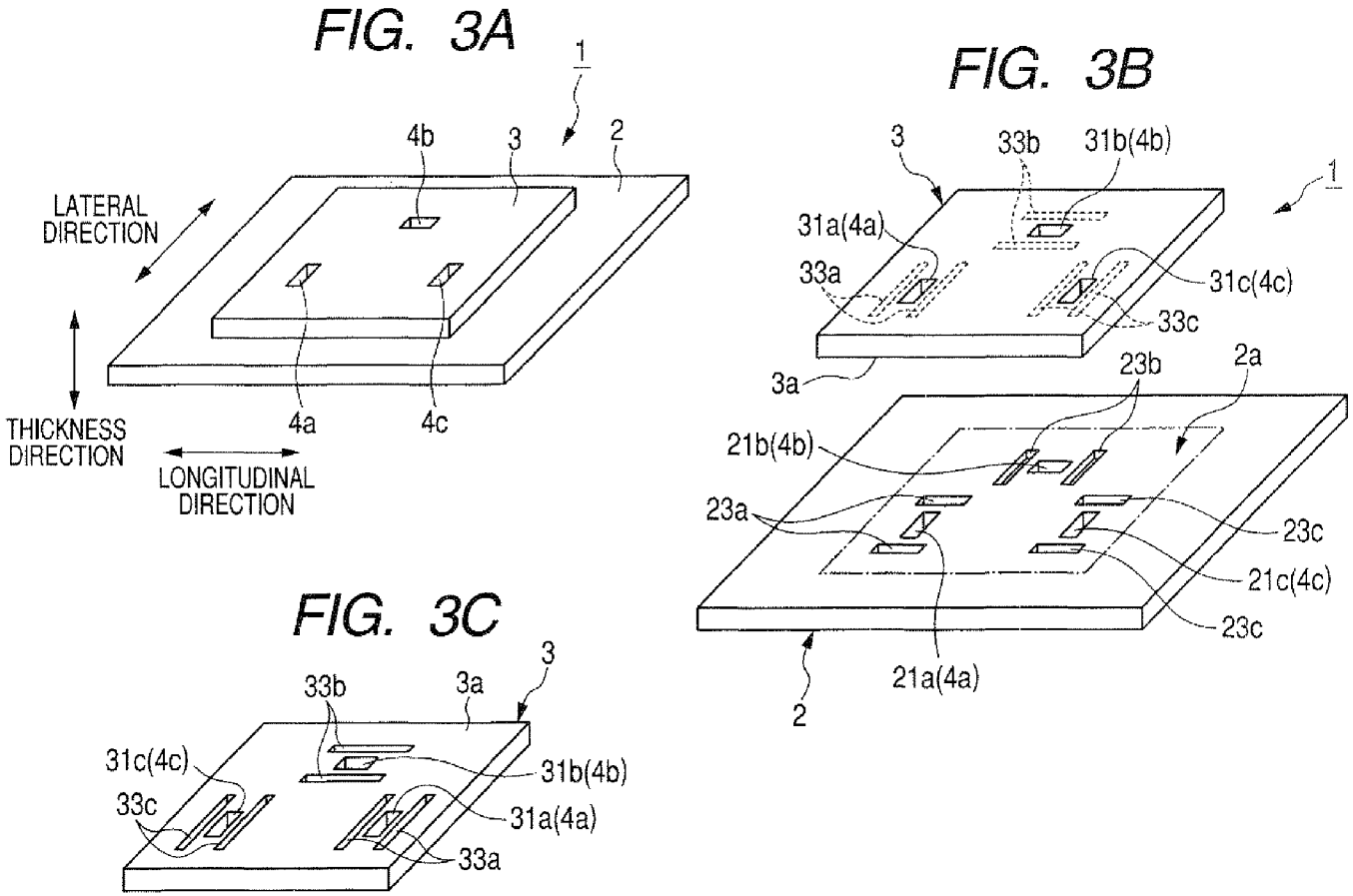
FIG. 3A is a perspective side view of a high-frequency device representing a high-frequency member assembly with waveguides according to the first embodiment of the present invention.
FIG. 3B is an exploded view of the device shown in FIG. 3A.
FIG. 3C is a perspective side view of an upper high-frequency member of the device shown in FIG. 3A.

FIG. 3A is a perspective side view of a high-frequency device representing a high-frequency member assembly with waveguides according to the first embodiment of the present invention. FIG. 3B is an exploded view of the device, while FIG. 3C is a perspective side view of an upper high-frequency member of the device. A high-frequency device 1 shown in FIG. 3A is used for a radar transceiver transmitting and receiving an electromagnetic wave such as millimeter wave, microwave or the like.

As shown in FIG. 3A, FIG. 3B and FIG. 3C, the device 1 representing a high-frequency member assembly has a pair of high-frequency members 2 and 3 layered along the thickness direction of the device 1. A surface 2*a* of the member 2 and a surface 3*a* of the member 3 are attached to each other in an attaching area by screws or the like to form the high-frequency member assembly. Each member is formed of a waveguide plate made of a conductive material such as a metal. The device 1 has inner walls to form a plurality of rectangular waveguides 4 (in this embodiment, three waveguides 4*a*, 4*b* and 4*c*). Each waveguide 4 penetrates through the members 2 and 3 in the thickness direction and is formed in a rectangular shape in a plane orthogonal to the thickness direction. Areas of the waveguides 4 in the plane are, for example, the same. An electromagnetic wave having a free space wavelength (or an effective wavelength) A is transmitted through each of the waveguides 4 in the thickness direction. The thickness of each of the members 2 and 3 is set to be larger than a quarter of the wavelength (i.e., $\lambda/4$).

The member 2 has inner walls to form three waveguide holes 21 (i.e., 21*a*, 21*b* and 21*c*). Each waveguide hole 21 penetrates through the member 2 in the thickness direction. The member 3 has inner walls to form three waveguide holes 31 (i.e., 31*a*, 31*b* and 31*c*). Each waveguide hole 31 penetrates through the member 3 in the thickness direction and communicates with the respective waveguide holes 21. The combination of the holes 21*a* and 31*a* communicating with each other forms the waveguide 4*a*. The combination of the holes 21*b* and 31*b* communicating with each other forms the waveguide 4*b*. The combination of the holes 21*c* and 31*c* communicating with each other forms the waveguide 4*c*.

Each of the holes 21 and 31 has a rectangular opened end having two longer sides and two shorter sides on the surface 2*a* or 3*a*. That is, each waveguide 4 has rectangular opened ends on the surfaces 2*a* and 3*a*. For example, each longer side in the opened ends of the holes 21*a*, 21*c*, 31*a* and 31*c* extends in the lateral direction orthogonal to the thickness direction, and each longer side in the opened ends of the holes 21*b* and 31*b* extends in the longitudinal direction orthogonal to the thickness and lateral directions.

The member 2 has inner walls to form three pairs of choke grooves 23 (i.e., 23*a*, 23*b* and 23*c*), and the member 3 has inner walls to form three pairs of choke grooves 33 (i.e., 33*a*, 33*b* and 33*c*). Each groove 23 is opened on the surface 2*a* to have an opened end, and each groove 33 is opened on the surface 3*a* to have an opened end. None of the choke grooves penetrate through the corresponding member in the thickness direction. Each pair of choke grooves 23 is disposed so as to place one corresponding waveguide hole 21 between the grooves 23. That is, the waveguide hole 21*a* is placed between the grooves 23*a*, the waveguide hole 21*b* is placed between the grooves 23*b*, and the waveguide hole 21*c* is placed between the grooves 23*c*. Each pair of the choke grooves 33 is disposed so as to place one corresponding waveguide hole 31 between the grooves 33. That is, the waveguide hole 31*a* is placed between the grooves 33*a*, the waveguide hole 31*b* is placed between the grooves 33*b*, and the waveguide hole 31*c* is placed between the grooves 33*c*.

Each of the choke grooves 23 corresponding to one waveguide 4 extends in a first direction, while each of the choke grooves 33 corresponding to the waveguide 4 extends in a second direction orthogonal to the first direction. More specifically, each of the choke grooves 23 corresponding to one waveguide hole 21 of one waveguide 4 extends straight along the shorter side of the opened end of the waveguide hole 21, while each of the choke grooves 33 corresponding to the waveguide hole 31 of the waveguide 4 extends straight along the longer side of the opened end of the waveguide hole 31. For example, the choke grooves 23 extend to be parallel to the respective shorter sides of the opened ends of the waveguide holes 21, while the choke grooves 33 extend to be parallel to the respective longer sides of the opened ends of the waveguide holes 31.

Further, the length of each choke groove 23 or 33 in its extending direction is set such that each pair of choke grooves 23 corresponding to one waveguide 4 overlaps with the pair of choke grooves 33 corresponding to the waveguide 4 in the thickness direction to communicate with the pair of choke grooves 33. More specifically, the choke grooves 23*a* overlap with the choke grooves 33*a* in the thickness direction to communicate with the grooves 33*a*, the choke grooves 23*b* overlap with the choke grooves 33*b* in the thickness direction to communicate with the grooves 33*b*, and the choke grooves 23*c* overlap with the choke grooves 33*c* in the thickness direction to communicate with the grooves 33*c*.

That is, the pair of choke grooves 23 and the pair of choke grooves 33 overlapping with each other are not placed in the same plane orthogonal to the thickness direction. However, when the choke grooves 23 and 33 are seen along the thickness direction, each waveguide 4 is surrounded by one pair of choke grooves 23 and one pair of choke grooves 33 communicating with each other in all directions in the plane orthogonal to the thickness direction. Therefore, with respect to the prevention of the leakage of the electromagnetic wave from an open space between the members 2 and 3, a choke structure formed of the pair of choke grooves 23 and the pair of choke grooves 33 communicating with each other is placed so as to substantially surround the corresponding waveguide 4 in the attaching area between the members 2 and 3. For example, a choke structure formed of the choke grooves 23*a* and 33*a* substantially surrounds the waveguide 4*a* in the attaching area between the members 2 and 3, a choke structure formed of the choke grooves 23*b* and 33*b* substantially surrounds the waveguide 4*b* in the attaching area between the members 2 and 3, and a choke structure formed of the choke grooves 23*c* and 33*c* substantially surrounds the waveguide 4*c* in the attaching area between the members 2 and 3.

Figure 4A:
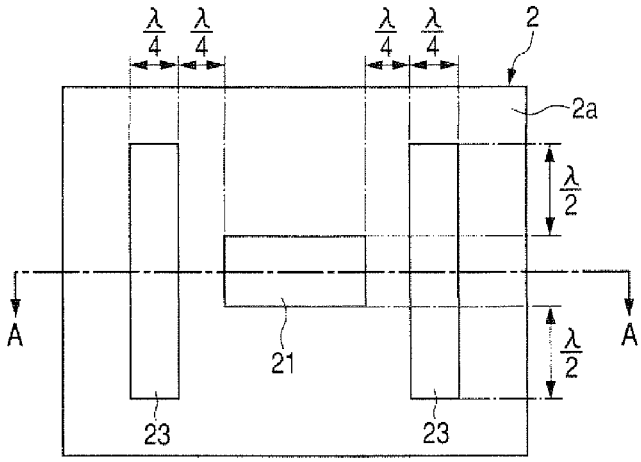
FIG. 4A is a top view of a high-frequency member of the device shown in FIG. 3A.

The positional relationship between each pair of choke grooves 23 and the waveguide hole 21 disposed between the grooves 23 will be described with reference to FIGS. 4A and 4B. FIG. 4A is a top view of the member 2, while FIG. 4B is a sectional view taken substantially along line A-A of FIG. 4A.

Figure 4B:
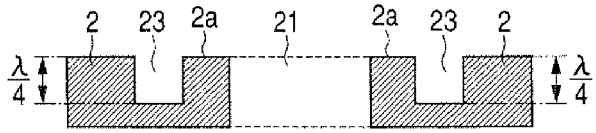
FIG. 4B is a sectional view taken substantially along line A-A of FIG. 4A.

As shown in FIGS. 4A and 4B, each choke groove 23 is away from the shorter side of the waveguide hole 21 approximately by one quarter $\lambda/4$ of the wavelength. The width of the choke groove 23 in a direction orthogonal to both the thickness direction and the extending direction of the choke groove 23 is approximately equal to $\lambda/4$. The depth of the choke groove 23 in the thickness direction is approximately equal to $\lambda/4$. Further, each end of the choke groove 23 in the extending direction of the shorter side of the hole 21 is protruded from the hole 21 in the extending direction approximately by a half $\lambda/2$ of the wavelength. Therefore, the length of the choke groove 23 in the extending direction is longer than that of the shorter side of the hole 21 approximately by the wavelength $\lambda$.

Figure 5A:
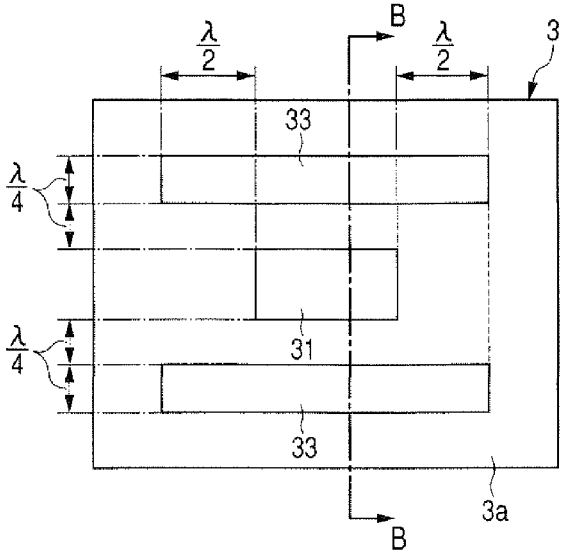
FIG. 5A is a bottom view of another high-frequency member of the device shown in FIG. 3A.

The positional relationship between each pair of choke grooves 33 and the waveguide hole 31 disposed between the grooves 33 will be described with reference to FIGS. 5A and 5B. FIG. 5A is a bottom view of the member 3, while FIG. 5B is a sectional view taken substantially along line B-B of FIG. 5A.

Figure 5B:
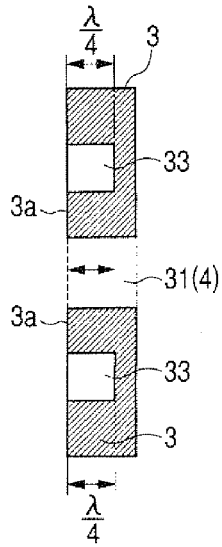
FIG. 5B is a sectional view taken substantially along line B-B of FIG. 5A.

As shown in FIGS. 5A and 5B, each choke groove 33 is away from the longer side of the waveguide hole 31 approximately by one quarter $\lambda/4$ of the wavelength. The width of the choke groove 33 in a direction, which is orthogonal to the longer side of the hole 31 and along which the choke groove 33 is away from the longer side of the waveguide hole 31, is approximately equal to $\lambda/4$. The depth of the choke groove 33 in the thickness direction is approximately equal to $\lambda/4$. Further, each end of the choke groove 33 in the extending direction of the longer side of the hole 31 is protruded from the hole 31 in the extending direction approximately by a half of the wavelength (i.e., $\lambda/2$). Therefore, the length of the choke groove 33 in the extending direction is longer than that of the longer side of the hole 31 approximately by the wavelength $\lambda$.

Figure 6A:
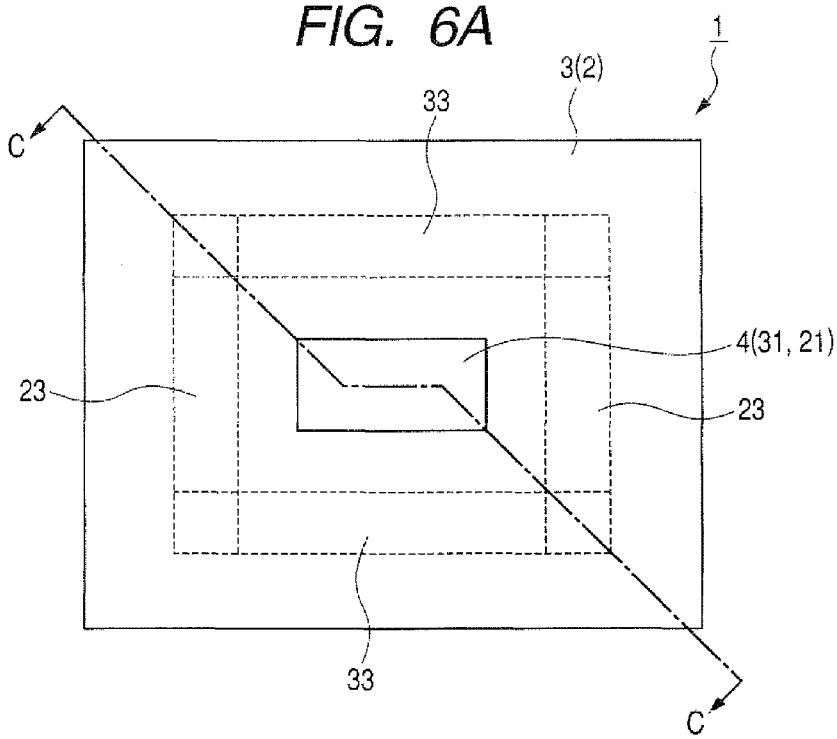
FIG. 6A is a top view of a waveguide and choke grooves surrounding the waveguide in the device shown in FIG. 3A.
Figure 6B:
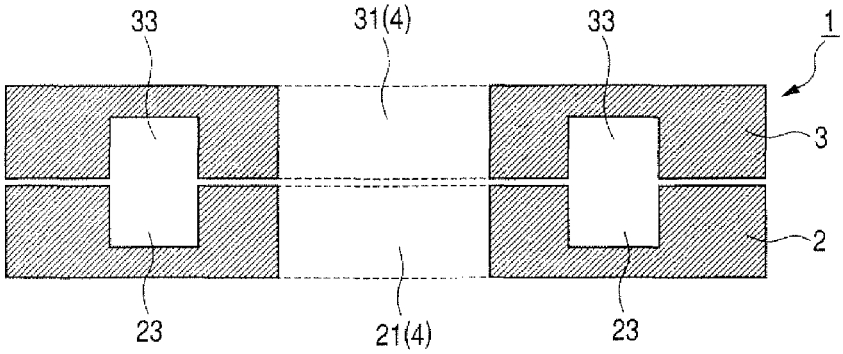
FIG. 6B is a sectional view taken substantially along line C-C of FIG. 6A.

FIG. 6A is a top view of a waveguide and choke grooves surrounding the waveguide in the device shown in FIG. 3A, while FIG. 6B is a sectional view taken substantially along line C-C of FIG. 6A.

As shown in FIG. 6A and FIG. 6B, in the device 1 having the members 2 and 3 attached to each other, one pair of choke grooves 23 and one pair of choke grooves 33 extending along the sides of the opened end of each waveguide 4 overlap with each other at ends of the grooves 23 and 33 in the thickness direction. This overlapping area is formed in a square shape having four sides set at the same length of $\lambda/4$. Therefore, each waveguide 4 of the device 1 is substantially surrounded by a choke structure formed of one pair of choke grooves 23 and one pair of choke grooves 33 in the attaching area between the members 2 and 3.

With this structure of the device 1 an electromagnetic wave with a communication signal is transmitted through each waveguide 4 in a propagation direction parallel to the thickness direction. The wave has a free space wavelength $\lambda$. Then, the wave with the signal is radiated from the device 1.

Each waveguide 4 of the device 1 is substantially surrounded by a choke structure formed of one pair of choke grooves 23 and one pair of choke grooves 33 in the attaching area between the members 2 and 3. Each choke groove is separated from the waveguide 4 by $\lambda/4$ and has the depth of $\lambda/4$. Therefore, even when a small opening is formed between the surfaces 2*a* and 3*a* of the members 2 and 3, the device 1 can prevent the electromagnetic wave from being leaked from the opening.

Accordingly, the device 1 representing the high-frequency member assembly can efficiently transmit the wave with the signal. For example, a radar transceiver with the device 1 can efficiently transmit the wave with a searching signal to an object and can efficiently receive the wave with a response signal reflected on the object to determine a position of the object relative to the device 1.

Further, each choke groove 23 or 33 having a rectangular shape in section is formed straight. Therefore, the choke groove has the most simplified shape. Accordingly, the device 1 with the choke grooves 23 and 33 can be easily manufactured.

Moreover, the length of each choke groove 23 or 33 can be easily set such that each pair of choke grooves 23 and each pair of choke grooves 33 corresponding to one waveguide 4 are overlapped with each other. Accordingly, each waveguide 4 can be reliably surrounded by a choke structure formed of one pair of choke grooves 23 and one pair of choke grooves 33 in the attaching area between the members 2 and 3 in all directions in the plane orthogonal to the thickness direction.

In this embodiment, ends of any pair of choke grooves 23 are extended straight along the shorter sides of the waveguide hole 21 placed between the grooves 23, while ends of any pair of choke grooves 33 are extended straight along the longer sides of the waveguide hole 31 placed between the grooves 33. However, ends of one pair of choke grooves 23 may be extended straight along the longer sides of the waveguide hole 21 placed between the grooves 23, while ends of the pair of choke grooves 33 overlapping with the pair of choke grooves 23 are extended straight along the shorter sides of the waveguide hole 31 communicating with the waveguide hole 21.

Further, in this embodiment, each of the members 2 and 3 is made of a conductive material. However, at least one high-frequency member may be made of resin while the inner walls of the member surrounding the waveguide holes and the choke grooves are coated or plated with a conductive material. In this case, electric potentials of the inner walls surrounding each waveguide hole can be set at the same level, and electric potentials of the inner walls surrounding each choke groove can be set at the same level.

Modifications of First Embodiment

In the first embodiment, each waveguide 4 is surrounded by two straight choke grooves facing respective shorter sides of the opened end of the waveguide and other two straight choke grooves facing respective longer sides of the opened end of the waveguide. However, at least one choke groove may face a plurality of sides of the opened end of the waveguide.

Figure 7:
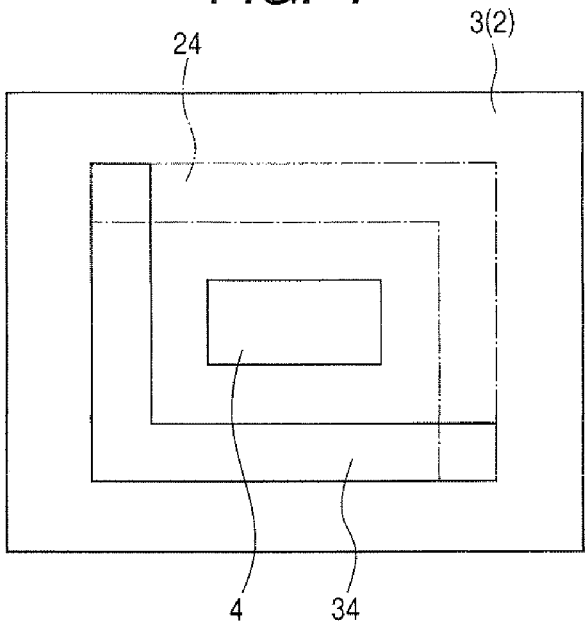
FIG. 7 is an explanatory view of the positional relationship between choke grooves of respective members in a high-frequent member assembly according to the first modification of the first embodiment.

FIG. 7 is an explanatory view of the positional relationship between choke grooves of the respective members 2 and 3 according to the first modification of the first embodiment.

As shown in FIG. 7, one rectangular waveguide 4 penetrates through a high-frequency member assembly having the high-frequency members 2 and 3 attached to each other, and an electromagnetic wave set at a free space wavelength A is transmitted through the waveguide 4. The member 3 has a choke groove 34 opened on its surface 3*a*. The choke groove 34 extends in an L-shape while facing a pair of longer and shorter sides of the waveguide 4 placed at its end opened between the members 2 and 3. The member 2 has a choke groove 24 opened on its surface 2*a*. The choke groove 24 extends in an L-shape while facing the other pair of longer and shorter sides of the waveguide 4 placed at its end opened between the members 2 and 3. Each of the grooves 24 and 34 is placed to be away from the waveguide 4 by λ/4. The ends of the groove 24 overlap with the ends of the groove 34 in the thickness direction.

With this structure of the assembly, with respect to the prevention of leaking the electromagnetic wave from an open space between the members 2 and 3, a choke structure formed of the grooves 24 and 34 substantially surrounds the waveguide 4 in the attaching area between the members 2 and 3.

Accordingly, in the same manner as in the first embodiment, the assembly can efficiently prevent the electromagnetic wave from being leaked from an open space between the members 2 and 3, and the grooves 24 and 34 of the assembly can be easily formed.

Figure 8:
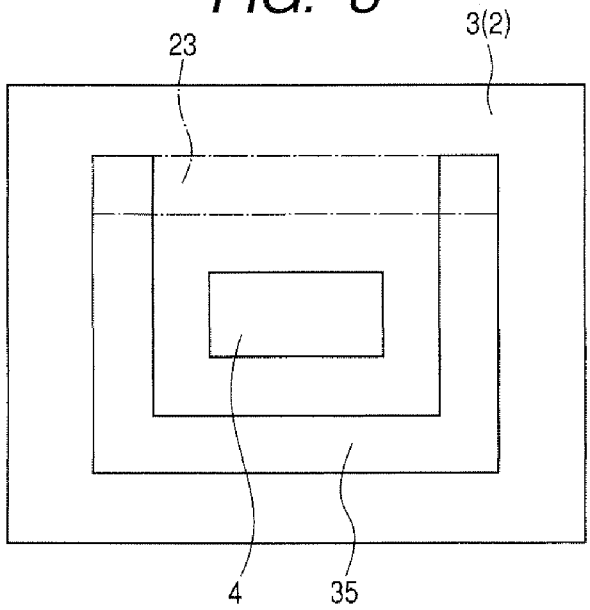
FIG. 8 is an explanatory view of the positional relationship between choke grooves of respective members in a high-frequent member assembly according to the second modification of the first embodiment.

FIG. 8 is an explanatory view of the positional relationship between choke grooves of the respective members 2 and 3 according to the second modification of the first embodiment.

As shown in FIG. 8, the member 3 of a high-frequency member assembly has a choke groove 35 opened on its surface 3*a*. The choke groove 35 extends in an approximately U-shape while facing one longer side and two shorter sides of the waveguide 4. The member 2 has one choke groove 23 extending straight while facing the other longer side of the waveguide 4. Each of the grooves 23 and 35 is placed to be away from the waveguide 4 by λ/4. The ends of the groove 23 overlap with the ends of the groove 35 in the thickness direction.

With this structure of the assembly, with respect to the prevention of leaking the electromagnetic wave from an open space between the members 2 and 3, a choke structure formed of the grooves 23 and 35 substantially surrounds the waveguide 4 in the attaching area between the members 2 and 3.

Accordingly, in the same manner as in the first embodiment, the assembly can efficiently prevent the electromagnetic wave from being leaked from an open space between the members 2 and 3, and the grooves 23 and 35 of the assembly can be easily formed.

In the first embodiment, the device 1 has the rectangular waveguides 4. However, the device 1 may have a circular waveguide, an elliptic waveguide or the like.

Figure 9A:
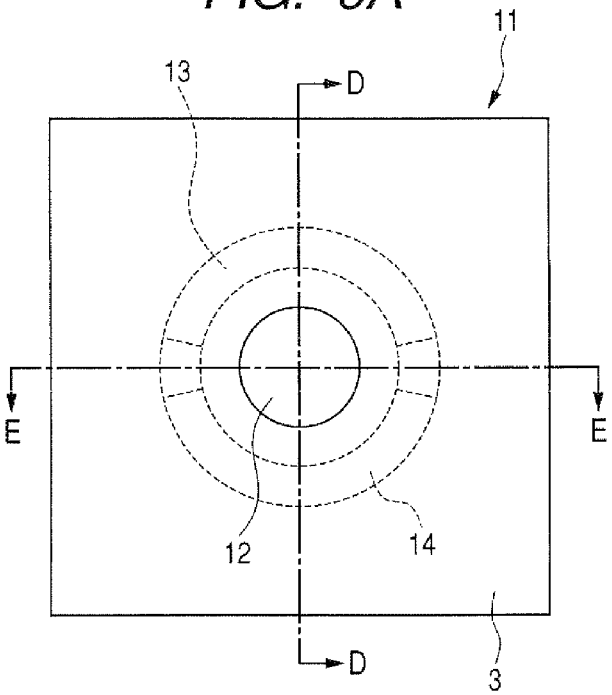
FIG. 9A is an upper view of a high-frequency member assembly with a circular waveguide according to the third modification of the first embodiment.
Figure 9B:
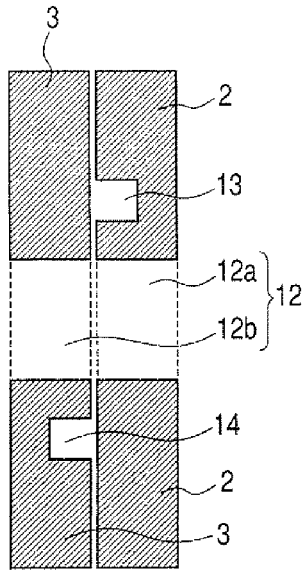
FIG. 9B is a sectional view taken substantially along line D-D of FIG. 9A.

FIG. 9A is an upper view of a high-frequency member assembly with a circular waveguide according to the third modification of the first embodiment. FIG. 9B is a sectional view taken substantially along line D-D of FIG. 9A, while FIG. 9C is a sectional view taken substantially along line E-E of FIG. 9A.

Figure 9C:
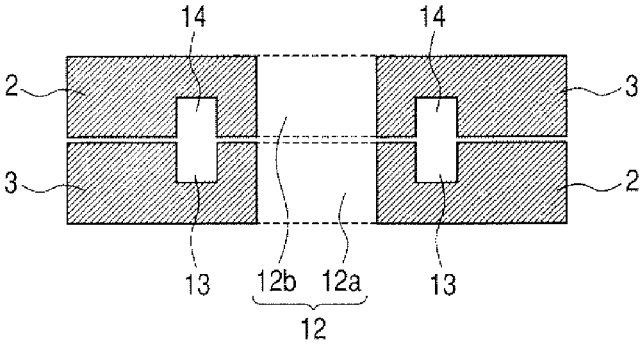
FIG. 9C is a sectional view taken substantially along line E-E of FIG. 9A.

As shown in FIG. 9A, FIG. 9B and FIG. 9C, a high-frequency device 11 representing a high-frequency member assembly has the high-frequency members 2 and 3 layered with each other in the thickness direction. The member 2 has inner walls to form a circular waveguide hole 12*a* penetrating through the member 2 in the thickness direction and a fan-shaped choke groove 13 opened on the upper surface of the member 2. The member 3 has inner walls to form a circular waveguide hole 12*b* penetrating through the member 3 in the thickness direction and a fan-shaped choke groove 14 opened on the lower surface of the member 3. The waveguide holes 12*a* and 12*b* are placed on the same plane orthogonal to the thickness direction to form a circular waveguide 12. An electromagnetic wave is transmitted through the waveguide 12. The groove 13 extends along the circular side of an end of the waveguide hole 12*a* opened on the upper surface of the member 2 to be away from the end of the hole 12*a* by one quarter of the wavelength of the wave (i.e., by λ/4). The groove 14 extends along the circular side of an end of the waveguide hole 12*b* opened on the lower surface of the member 3 to be away from the end of the hole 12*b* by one quarter of the wavelength (i.e., λ/4). Ends of the groove 13 overlap with respective ends of the groove 14 in the thickness direction.

Accordingly, in the same manner as the device 1 having the rectangular waveguides 4 shown in FIG. 3A, a choke structure composed of the grooves 13 and 14 can be reliably disposed in the device 11 to surround the waveguide 12 in the attaching area between the members 2 and 3.

Second Embodiment

Figure 10B:
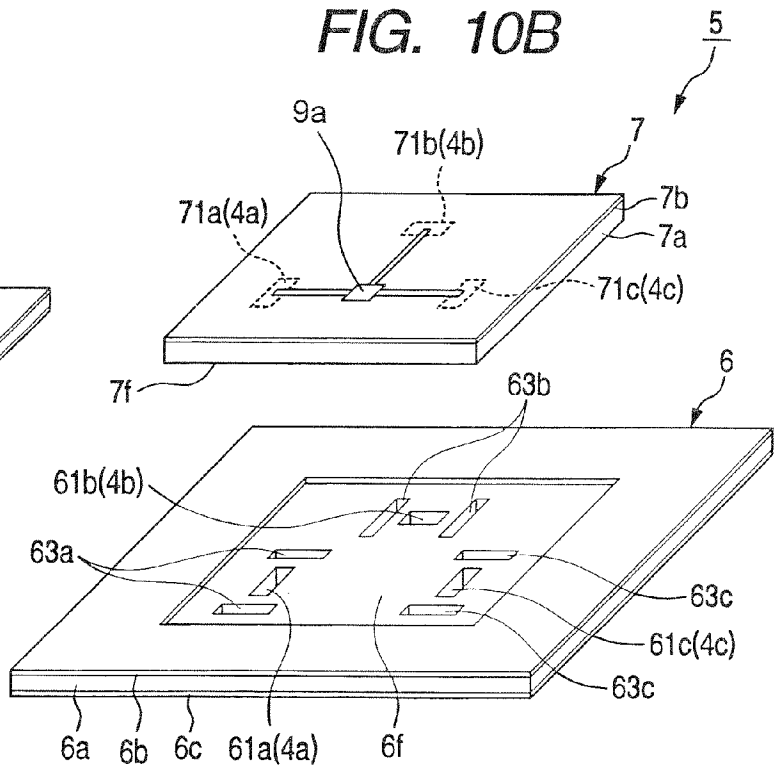
FIG. 10B is an exploded view of the device shown in FIG. 10A.
Figure 10A:
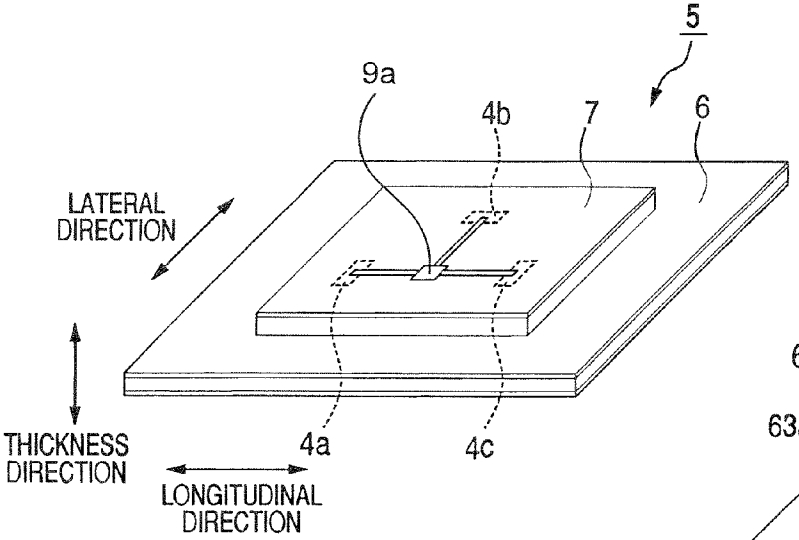
FIG. 10A is a perspective side view of a high-frequency device representing a high-frequency member assembly with waveguides according to the second embodiment of the present invention.

FIG. 10A is a perspective side view of a high-frequency device representing a high-frequency member assembly with waveguides according to the second embodiment of the present invention. FIG. 10B is an exploded view of the device shown in FIG. 10A. A high-frequency device 5 shown in FIG. 10A is used for a radar transceiver.

As shown in FIG. 10A and FIG. 10B, the device 5 representing a high-frequency member assembly has a pair of high-frequency members 6 and 7 layered along the thickness direction of the device 5. A surface 6*f* of the member 6 and a surface 7*f* of the member 7 are attached to each other in an attaching area by screws or the like to form the high-frequency member assembly. The member 6 is composed of a waveguide plate 6*a* made of a conductive material such as a metal, a first substrate 6*b* attached to the peripheral portion of a front surface of the plate 6*a*, and a second substrate 6*c* attached to a rear surface of the plate 6*a*. Each of the substrates 6*b* and 6*c* is made of a dielectric material. The plate 6*a* has the attaching surface 6*f* placed in the center portion of its front surface. The attaching surface 6*f* is surrounded by the peripheral portion of the front surface. The member 7 is composed of a waveguide plate 7*a* made of a conductive material such as a metal and a third substrate 7*b* attached to the front surface of the plate 7*a*. The substrate 7*b* is made of a dielectric material. The plate 7*a* has the attaching surface 7*f* opposite to its front surface. The substrate 6*b* is formed in a rectangular frame shape so as to surround the plate 7*a* in the plane orthogonal to the thickness direction.

The device 5 has inner walls to form a plurality of rectangular waveguides 4 (in this embodiment, three waveguides 4*a*, 4*b* and 4*c*). Each waveguide 4 penetrates through the plates 6*a* and 7*a* in the thickness direction and is formed in a rectangular shape in a plane orthogonal to the thickness direction. Areas of the waveguides 4 in the plane orthogonal to the thickness direction are, for example, the same. An electromagnetic wave having a free space wavelength λ is transmitted through each of the waveguides 4 in the thickness direction. The thickness of each of the plates 6*a* and 7*a* is approximately set at λ/4.

The plate 6*a* has inner walls to form three waveguide holes 61 (i.e., 61*a*, 61*b* and 61*c*). Each waveguide hole 61 penetrates through the plate 6*a* in the thickness direction. The plate 7*a* has inner walls to form three waveguide holes 71 (i.e., 71*a*, 71*b* and 71*c*). Each waveguide hole 71 penetrates through the plate 7*a* in the thickness direction and communicates with one waveguide hole 61. The holes 61*a* and 71*a* communicating with each other form the waveguide 4*a*. The holes 61*b* and 71*b* communicating with each other form the waveguide 4*b*. The holes 61*c* and 71*c* communicating with each other form the waveguide 4*c*.

The plate 6*a* has inner walls to form three pairs of choke holes 63 (i.e., 63*a*, 63*b* and 63*c*). Each choke hole 63 penetrates through the plate 6*a* in the thickness direction. The plate 7*a* has inner walls to form three pairs of choke holes (not shown). Each choke hole of plate 7*a* penetrates through the plate 7*a* in the thickness direction.

The shape and size of each of the waveguide holes 61 and 71 in the plane orthogonal to the thickness direction are the same as those of the holes 21 and 31 shown in FIG. 3A, FIG. 3B and FIG. 3C. The shape and size of each of the choke holes of the plates 6*a* and 7*a* in the plane orthogonal to the thickness direction are the same as those of the grooves 23 and 33 shown in FIG. 3A, FIG. 3B and FIG. 3C. Further, the positional relationship among the pairs of choke holes of the plates 6*a* and 7*a* and the waveguide holes 61 and 71 is the same as the positional relationship among the pairs of choke grooves 23 and 33 and the waveguide holes 21 and 31 shown in FIG. 3A, FIG. 3B and FIG. 3C.

On the front surface of the third substrate 7*b* opposite to its rear surface attached to the plate 7*a*, a high-frequency circuit (not shown) is formed. This circuit has an oscillator 9*a* for generating an electromagnetic wave as a high-frequency signal, a wave-guiding channel (not shown in detail) for leading the electromagnetic wave to an end of each waveguide 4 opened on the front surface of the plate 7*a*, a transformer (not shown) for connecting each wave-guiding channel (not shown) with the corresponding waveguide 4 to transmit the electromagnetic wave to the waveguide 4.

On the front surface of the first substrate 6*b* opposite to its rear surface attached to the plate 6*a*, a base band circuit (not shown) is formed. This circuit modulates the electromagnetic wave of the oscillator 9*a* with a communication signal to produce a modulation signal set within a frequency range of the base band. This modulation signal denotes the communication signal superimposed on the electromagnetic wave. The modulation signal passes through the wave-guidinq channels, the transformer and the waveguides 4.

On the rear surface of the third substrate 6*c* opposite to its front surface attached to the plate 6*a*, an antenna (not shown) is formed. This antenna radiates the modulation signal passing through the waveguides 4 to an object and receives a response signal obtained by reflection of the modulation signal from the object.

An end of each choke hole 63 opened on the rear surface of the plate 6*a* is covered with a portion of the substrate 6*c*. Therefore, the hole 63 has a bottom wall formed of the covering portion of the substrate 6*c*. Further, a ground pattern formed of a copper film is disposed on the front surface of this covering portion of the substrate 6*c*. Therefore, the choke hole 63 is surrounded by the side walls of the plate 6*a* made of the conductive material and the ground pattern of the bottom wall. That is, electric potentials of these walls are maintained at the same value, so that a choke groove 63 having the depth of λ/4 is formed by the hole 63 surrounded by the bottom and side walls made of the conductive material.

An end of each choke hole of plate 7*a* opened on the front surface of the plate 7*a* is covered with a portion of the substrate 7*b*, and another ground pattern formed of a copper film is disposed on the front surface of this covering portion of the substrate 7*b*. Therefore, a choke groove of the plate 7*a* having the depth of λ/4 is formed by the choke hole surrounded by the bottom and side walls made of the conductive material.

Therefore, in the same manner as in the first embodiment, because each waveguide 4 of the device 5 is substantially surrounded by a choke structure formed of one pair of choke grooves 63 and one pair of choke grooves of the plate 7*a* in the attaching area between the members 6 and 7, the device 5 can prevent the modulation signal from being leaked from an open space between the members 6 and 7. Accordingly, the device 5 representing the high-frequency member assembly can efficiently output the modulation signal.

Further, each choke groove can be easily formed by forming a through hole in the plate 6*a* or 7*a* by the press working. Accordingly, the manufacturing process of the device 5 can be simplified.

Moreover, none of the choke grooves surround the corresponding waveguide 4, but the choke grooves disposed on the respective members 6 and 7 surround the corresponding waveguide. Therefore, each choke groove penetrating through the plate 6*a* or 7*a* can be easily formed without using a supporting member. Accordingly, the device 5 can be easily manufactured.

The first modification of the first embodiment can be applied for the device 5 according to the second embodiment. More specifically, the device 5 shown in FIG. 10A and FIG. 10B may have the choke grooves 24 and 34 in place of the choke holes of the plates 6*a* and 7*a*.

The second modification of the first embodiment can be applied for the device 5 according to the second embodiment. More specifically, the device 5 shown in FIG. 10A and FIG. 10B may have the choke grooves 23 and 35 in place of the choke holes of the plates 6*a* and 7*a*.

Modification of Second Embodiment

In the second embodiment, the opened end of each choke hole 63 is covered with the ground pattern formed in the second substrate 6*c* to form the hole 63 into the choke groove 63. However, the opened end of each choke hole 63 may be covered with a waveguide plate while the corresponding waveguide 4 penetrates through the waveguide plate.

Figure 11B:
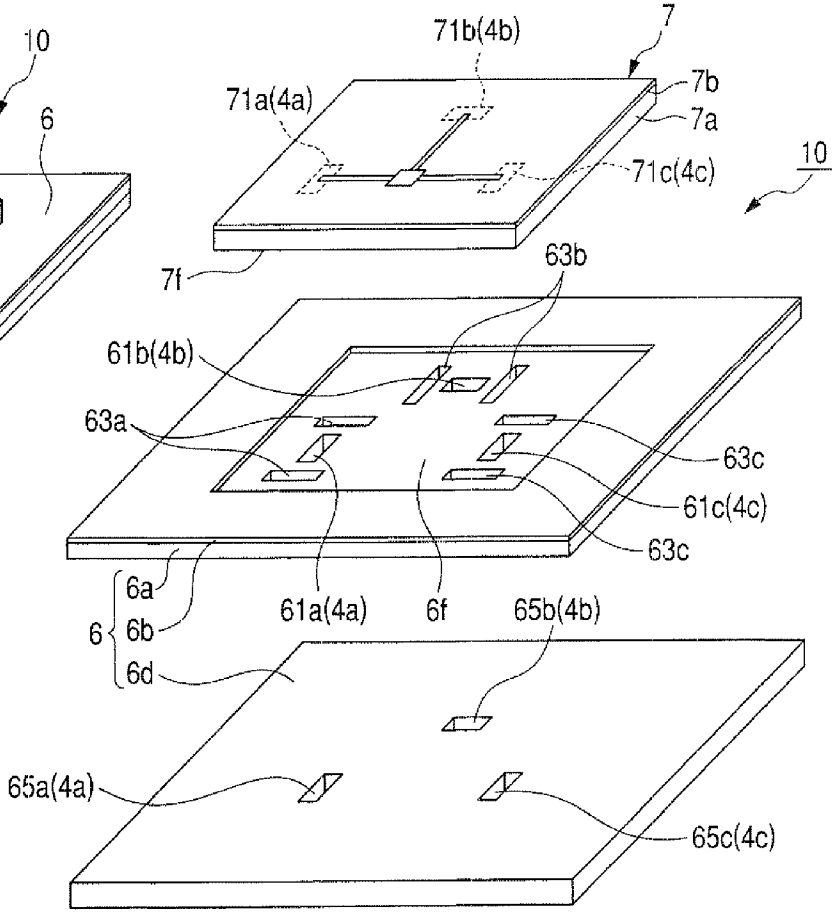
FIG. 11B is an exploded view of the device shown in FIG. 11A.
Figure 11A:
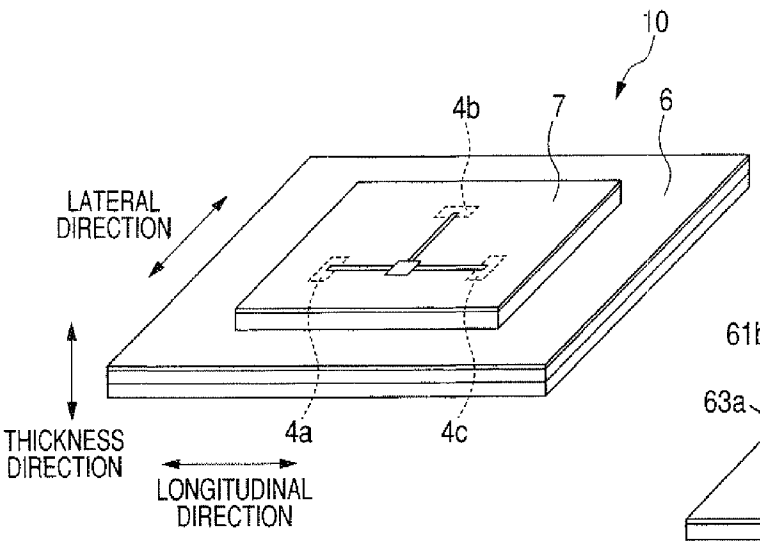
FIG. 11A is a perspective side view of a high-frequency device representing a high-frequency member assembly with waveguides according to a modification of the second embodiment.

FIG. 11A is a perspective side view of a high-frequency device 10 representing a high-frequency member assembly with waveguides according to a modification of the second embodiment, while FIG. 11B is an exploded view of the device shown in FIG. 11A.

As shown in FIG. 11A and FIG. 11B, the high-frequency device 10 differs from the device 5 shown in FIG. 10A and FIG. 10B in that the high-frequency member 6 has a waveguide plate 6*d* in place of the substrate 6*c*. The plate 6*d* is made of a conductive material such as a metal. The plate 6*d* has three waveguide holes 65 (i.e., 65*a*, 65*b* and 65*c*) penetrating through the plate 6*d* in the thickness direction. Each hole 65 communicates with the corresponding waveguide holes 61 and 71 to form one waveguide 4.

Therefore, the end of each choke hole 63 opened on its rear surface is covered with the plate 6*d*, so that the hole 63 is formed into one choke groove 63.

With this structure, an electromagnetic wave transmitted through each waveguide 4 can be outputted from the device 10 through one waveguide hole 6*d*, and an electromagnetic wave can enter each waveguide 4 through one waveguide hole 65. Further, each waveguide 4 can be substantially surrounded by the choke grooves of the plates 6*a* and 7*a* in all directions in the attaching area between the members 6 and 7.

In this modification, the waveguide plate 6*d* is disposed in the device 10 in place of the substrate 6*c*. However, a metallic waveguide plate having three through holes may be disposed in the device 10 in place of the substrate 7*b* to cover ends of the choke holes of plate 7*a* opened on the front surface of the plate 7*a*. Each waveguide 4 penetrates through the holes of the metallic waveguide plate.

In the first and second embodiments, the distance between each waveguide 4 and the choke groove 23, 33, 63 or of the plate 7*a* may range from $0.8\times\lambda/4$ to $1.2\times\lambda/4$, the depth and width of each choke groove 23, 33, 63 or of the plate 7*a* may range from $0.8\times\lambda/4$ to $1.2\times\lambda/4$, and the length of each choke groove 23, 33, 63 or of the plate 7*a* protruding from the corresponding waveguide 4 may range from $0.8\times\lambda/2$ to $1.2\times\lambda/2$.

Further, each of the devices 1 and 5 may have a single waveguide substantially surrounded by a plurality of choke grooves in an attaching area between high-frequency members.

What is claimed is:

1. A choke structure for waveguides of a pair of high-frequency members, comprising:

said pair of high-frequency members that, respectively, have said waveguides and are attached to each other as a pair such that the waveguides communicate with each other, a choke structure for the waveguides being formed at an attaching point of the high-frequency members, wherein a single choke groove or a plurality of choke grooves are formed at a portion or portions of area located along open ends of the waveguides and being away from the open ends by $\lambda/4$ of a free space wavelength $\lambda$ of an electromagnetic wave transmitting through the waveguides at a depth substantially equal to $\lambda/4$ on each of attaching surfaces of the high-frequency members, and the choke grooves are arranged such that spaces formed by the choke grooves communicate with one another while substantially surrounding the waveguides when the high-frequency members are attached to each other, and wherein one of the high-frequency members comprises:

a waveguide plate, made of a conductive material, which has a plate thickness of $\lambda/4$ and has through holes forming the corresponding waveguide and the corresponding choke grooves and extending along a direction of the plate thickness; and a dielectric substrate which is attached to a surface of the waveguide plate on a side opposite to a side of the corresponding attaching surface and has ground patterns at portions covering open ends of the through holes forming the corresponding choke grooves to form bottom walls of the choke grooves, and the other high-frequency member comprises:

a first waveguide plate, made of a conductive material, which has a plate thickness of $\lambda/4$ and has through holes forming the corresponding waveguide and the corresponding choke grooves and extending along a direction of the plate thickness; and a second waveguide plate, made of a conductive material, which is attached to a surface of the first waveguide plate on a side opposite to a side of the corresponding attaching surface and has a through hole forming the corresponding waveguide extending along a direction of the second waveguide plate thickness.

2. A choke structure for waveguides of a pair of high-frequency members, comprising:

said pair of high-frequency members that, respectively, have said waveguides and are attached to each other as a pair such that the waveguides communicate with each other, a choke structure for the waveguides being formed at an attaching point of the high-frequency members, wherein a single choke groove or a plurality of choke grooves are formed at a portion or portions of area located along open ends of the waveguides and being away from the open ends by $\lambda/4$ of a free space wavelength $\lambda$ of an electromagnetic wave transmitting through the waveguides at a depth substantially equal to $\lambda/4$ on each of attaching surfaces of the high-frequency members, and the choke grooves are arranged such that spaces formed by the choke grooves communicate with one another while substantially surrounding the waveguides when the high-frequency members are attached to each other, and wherein each of the high-frequency members comprises:

a first waveguide plate, made of a conductive material, which has a plate thickness of λ/4 and has through holes forming the corresponding waveguide and the corresponding choke grooves and extending along a direction of the first waveguide plate thickness; and a second waveguide plate, made of a conductive material, which is attached to a surface of the first waveguide plate on a side opposite to a side of the corresponding attaching surface and has a through hole forming the corresponding waveguide extending along a direction of the second waveguide plate thickness.

3. A choke structure for waveguides of a pair of high-frequency members, comprising:

said pair of high-frequency members that, respectively, have said waveguides are plate shaped, and are attached to each other as a pair such that the waveguides communicate with each other, a choke structure for the waveguides being formed at an attaching point of the high-frequency members, wherein a single choke groove or a plurality of choke grooves are formed on a surface of each of the high-frequency members at a portion or portions of an area located along open ends of the waveguides and being spaced from the open ends by λ/4 of a free space wavelength λ of an electromagnetic wave transmitting through the waveguides to a depth substantially equal to λ/4 on each of attaching surfaces of the high-frequency members, and the choke grooves are arranged on the attaching surfaces of the high-frequency members such that spaces formed by the choke grooves communicate with one another and substantially surround the waveguides only when the high-frequency members are attached as said pair, with the attaching surfaces of the high-frequency members attached to each other.

4. The choke structure for the waveguides according to claim 3, wherein a width of each of the choke grooves is substantially equal to λ/4.

5. The choke structure for the waveguides according to claim 4, wherein each of the high-frequency members comprises:

a first waveguide plate, made of a conductive material, which has a plate thickness of λ/4 and has through holes forming the corresponding waveguide and the corresponding choke grooves and extending along a direction of the plate thickness; and a second waveguide plate, made of a conductive material, which is attached to a surface of the first waveguide plate on a side opposite to a side of the corresponding attaching surface and has a through hole forming the corresponding waveguide extending along the direction of the plate thickness.

6. The choke structure for the waveguides according to claim 4, wherein one of the high-frequency members comprises:

a waveguide plate, made of a conductive material, which has a plate thickness of λ/4 and has through holes forming the corresponding waveguide and the corresponding choke grooves and extending along a direction of the plate thickness; and a dielectric substrate which is attached to a surface of the waveguide plate on a side opposite to a side of the corresponding attaching surface and has ground patterns at portions covering open ends of the through holes forming the corresponding choke grooves to form bottom walls of the choke grooves, and the other high-frequency member comprises:

a first waveguide plate, made of a conductive material, which has a plate thickness of λ/4 and has through holes forming the corresponding waveguide and the corresponding choke grooves and extending along a direction of the first waveguide plate thickness; and a second waveguide plate, made of a conductive material, which is attached to a surface of the first waveguide plate on a side opposite to a side of the corresponding attaching surface and has a through hole forming the corresponding waveguide extending along a direction of the second waveguide plate thickness.

7. The choke structure for the waveguides according to claim 3, wherein the open end of each of the waveguides has a rectangular shape, one of the high-frequency members has each choke groove therein extending only along a longer side of the open end of the corresponding waveguide, and the other high-frequency member has each choke groove therein extending only along a shorter side of the open end of the corresponding waveguide.

8. The choke structure for the waveguides according to claim 7, wherein each of the high-frequency members comprises:

a first waveguide plate, made of a conductive material, which has a plate thickness of λ/4 and has through holes forming the corresponding waveguide and the corresponding choke grooves and extending along a direction of the first waveguide plate thickness; and a second waveguide plate, made of a conductive material, which is attached to a surface of the first waveguide plate on a side opposite to a side of the corresponding attaching surface and has a through hole forming the corresponding waveguide extending along a direction of the second waveguide plate thickness.

9. The choke structure for the waveguides according to claim 7, wherein one of the high-frequency members comprises:

a waveguide plate, made of a conductive material, which has a plate thickness of λ/4 and has through holes forming the corresponding waveguide and the corresponding choke grooves and extending along a direction of the plate thickness; and a dielectric substrate which is attached to a surface of the waveguide plate on a side opposite to a side of the corresponding attaching surface and has ground patterns at portions covering open ends of the through holes forming the corresponding choke grooves to form bottom walls of the choke grooves, and the other high-frequency member comprises:

a first waveguide plate, made of a conductive material, which has a plate thickness of λ/4 and has through holes forming the corresponding waveguide and the corresponding choke grooves and extending along a direction of the first waveguide plate thickness; and a second waveguide plate, made of a conductive material, which is attached to a surface of the first waveguide plate on a side opposite to a side of the corresponding attaching surface and has a through hole forming the corresponding waveguide extending along a direction of the second waveguide plate thickness.

10. The choke structure for the waveguides according to claim 3, wherein each of the high-frequency members comprises:

a waveguide plate, made of a conductive material, which has a plate thickness of λ/4 and has through holes forming the corresponding waveguide and the corresponding choke grooves and extending along a direction of the plate thickness; and a dielectric substrate which is attached to a surface of the waveguide plate on a side opposite to a side of the corresponding attaching surface and has ground patterns at portions covering open ends of the through holes forming the corresponding choke grooves to form bottom walls of the choke grooves.

11. The choke structure for the waveguides according to claim 3, wherein each of the high-frequency members comprises:

a first waveguide plate, made of a conductive material, which has a plate thickness of λ/4 and has through holes forming the corresponding waveguide and the corresponding choke grooves and extending along a direction of the first waveguide plate thickness; and a second waveguide plate, made of a conductive material, which is attached to a surface of the first waveguide plate on a side opposite to a side of the corresponding attaching surface and has a through hole forming the corresponding waveguide extending along a direction of the second waveguide plate thickness.

12. The choke structure for the waveguides according to claim 3, wherein one of the high-frequency members comprises:

a waveguide plate, made of a conductive material, which has a plate thickness of λ/4 and has through holes forming the corresponding waveguide and the corresponding choke grooves and extending along a direction of the plate thickness; and a dielectric substrate which is attached to a surface of the waveguide plate on a side opposite to a side of the corresponding attaching surface and has ground patterns at portions covering open ends of the through holes forming the corresponding choke grooves to form bottom walls of the choke grooves, and the other high-frequency member comprises:

a first waveguide plate, made of a conductive material, which has a plate thickness of λ/4 and has through holes forming the corresponding waveguide and the corresponding choke grooves and extending along a direction of the first waveguide plate thickness; and a second waveguide plate, made of a conductive material, which is attached to a surface of the first waveguide plate on a side opposite to a side of the corresponding attaching surface and has a through hole forming the corresponding waveguide extending along a direction of the second waveguide plate thickness.

* * * * *